US009049921B1

(12) United States Patent
Rackston

(10) Patent No.: US 9,049,921 B1
(45) Date of Patent: Jun. 9, 2015

(54) FLOSS-DISPENSING TOOTHBRUSH DEVICE

(71) Applicant: Dadrian L. Rackston, Coco, FL (US)

(72) Inventor: Dadrian L. Rackston, Coco, FL (US)

( * ) Notice: Subject to any disclaimer, the term of this patent is extended or adjusted under 35 U.S.C. 154(b) by 0 days.

(21) Appl. No.: 13/949,504

(22) Filed: Jul. 24, 2013

(51) Int. Cl.
*A45D 44/18* (2006.01)
*A46B 15/00* (2006.01)

(52) U.S. Cl.
CPC ..... *A46B 15/0071* (2013.01)

(58) Field of Classification Search
USPC ..... 132/308–309, 311, 324–325; 15/176.1–176.6; D4/108
See application file for complete search history.

(56) References Cited

U.S. PATENT DOCUMENTS

| | | | | | |
|---|---|---|---|---|---|
| 1,312,896 | A | * | 8/1919 | Donnelly | 132/309 |
| 1,427,857 | A | * | 9/1922 | Satterlee | 132/324 |
| 1,646,082 | A | * | 10/1927 | Dailey | 132/309 |
| 2,113,439 | A | * | 4/1938 | Bean | 132/309 |
| 2,233,522 | A | * | 3/1941 | Fickle | 132/309 |
| 2,233,936 | A | * | 3/1941 | Campbell | 132/325 |
| 2,601,244 | A | * | 6/1952 | Boulicault | 132/309 |
| 3,589,823 | A | * | 6/1971 | Hendrickson | 401/176 |
| 3,782,397 | A | * | 1/1974 | McCord | 132/309 |
| 3,853,134 | A | * | 12/1974 | McCord | 132/309 |
| 4,030,845 | A | * | 6/1977 | Deckert | 401/268 |
| 4,522,524 | A | * | 6/1985 | Green | 401/183 |
| 4,821,752 | A | * | 4/1989 | Widlak | 132/309 |
| 4,887,621 | A | * | 12/1989 | Vallieres | 132/309 |
| 4,987,910 | A | * | 1/1991 | Lowe | 132/309 |
| 5,369,835 | A | * | 12/1994 | Clarke | 15/167.1 |
| 5,439,014 | A | * | 8/1995 | Moussa | 132/311 |
| 5,463,792 | A | * | 11/1995 | Hogan et al. | 15/322 |
| 5,490,530 | A | * | 2/1996 | Snowden | 132/311 |
| 5,676,167 | A | | 10/1997 | Garner | |
| D397,554 | S | | 9/1998 | Sprague | |
| 5,865,195 | A | * | 2/1999 | Carter | 132/309 |
| 5,908,038 | A | * | 6/1999 | Bennett | 132/308 |
| 6,039,050 | A | * | 3/2000 | Goldenberg | 132/309 |
| 6,095,157 | A | * | 8/2000 | Brown | 132/309 |
| 6,105,195 | A | * | 8/2000 | Davis | 15/160 |
| 6,601,272 | B2 | * | 8/2003 | Stvartak et al. | 16/430 |
| 6,766,807 | B2 | * | 7/2004 | Piccolo et al. | 132/309 |
| 6,772,770 | B1 | * | 8/2004 | Williams, Sr. | 132/309 |
| 7,198,051 | B1 | * | 4/2007 | Festa | 132/309 |
| 7,201,172 | B2 | * | 4/2007 | Nanda | 132/309 |
| 7,237,560 | B2 | * | 7/2007 | Macias et al. | 132/309 |
| 7,246,400 | B2 | * | 7/2007 | Ryan | 15/185 |
| 7,594,292 | B1 | * | 9/2009 | Pelo | 15/106 |
| D623,416 | S | * | 9/2010 | St. Laurent | D4/108 |
| 8,015,982 | B2 | * | 9/2011 | Wilkinson | 132/309 |
| 8,075,216 | B2 | * | 12/2011 | Gatzemeyer et al. | 401/288 |
| 8,141,563 | B2 | * | 3/2012 | De Masi, Sr. | 132/309 |
| D668,460 | S | * | 10/2012 | Vazquez | D4/108 |

(Continued)

*Primary Examiner* — Rachel Steitz
*Assistant Examiner* — Jennifer Gill

(57) ABSTRACT

A floss-dispensing toothbrush device stores and dispenses floss while also cleaning a person's tongue. The toothbrush device includes an elongated member having a head coupled to a handle. A top and bottom side of the handle define an interior space of the handle. A plurality of bristles is coupled to and extends from the head. A ridged surface extends across the head and is configured for cleaning a person's tongue. A floss housing is coupled to and positioned in a floss cavity within the interior space of the handle. The floss housing is configured for receiving floss. A conduit extends from the floss cavity wherein the conduit is configured for guiding the floss through the handle. An aperture is positioned in the handle and coupled to the conduit. The aperture is configured for receiving the floss from the conduit wherein a person palls the floss out from the aperture.

16 Claims, 3 Drawing Sheets

(56) References Cited

U.S. PATENT DOCUMENTS

| | | | | |
|---|---|---|---|---|
| 8,511,323 | B2 * | 8/2013 | Jimenez et al. | 132/311 |
| D691,377 | S * | 10/2013 | Zarrabi et al. | D4/108 |
| 8,544,481 | B1 * | 10/2013 | Smith et al. | 132/309 |
| D703,443 | S * | 4/2014 | Gatzemeyer et al. | D4/101 |
| 8,726,915 | B1 * | 5/2014 | Wilkinson | 132/309 |
| D706,035 | S * | 6/2014 | Xi et al. | D4/108 |
| 2001/0039955 | A1 * | 11/2001 | Winters et al. | 132/309 |
| 2002/0121283 | A1 * | 9/2002 | Piccolo et al. | 132/309 |
| 2003/0188761 | A1 * | 10/2003 | Garcia et al. | 132/309 |
| 2004/0237995 | A1 | 12/2004 | Mualem et al. | |
| 2005/0210611 | A1 * | 9/2005 | Pelo | 15/106 |
| 2005/0268934 | A1 * | 12/2005 | Macias et al. | 132/309 |
| 2006/0260635 | A1 * | 11/2006 | Dabney | 132/309 |
| 2010/0186182 | A1 * | 7/2010 | Avila et al. | 15/167.1 |
| 2013/0000658 | A1 * | 1/2013 | Nguyen et al. | 132/200 |

* cited by examiner

FLOSS-DISPENSING TOOTHBRUSH DEVICE

BACKGROUND OF THE DISCLOSURE

Field of the Disclosure

The disclosure relates to toothbrush devices and more particularly pertains to a new toothbrush device for storing and dispensing floss while providing a ridged surface to clean a person's tongue.

SUMMARY OF THE DISCLOSURE

An embodiment of the disclosure meets the needs presented above by generally comprising an elongated member having a head coupled to a handle. A top side and a bottom side of the handle define an interior space of the handle. A plurality of bristles is coupled to and extends from the head. A ridged surface extends across the head and is configured for cleaning a person's tongue. A floss housing is coupled to and positioned in a floss cavity within the interior space of the handle. The floss housing is configured for receiving floss. A conduit extends from the floss cavity wherein the conduit is configured for guiding the floss through the handle. An aperture is positioned in the handle and coupled to the conduit. The aperture is configured for receiving the floss from the conduit wherein a person pulls the floss out from the aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
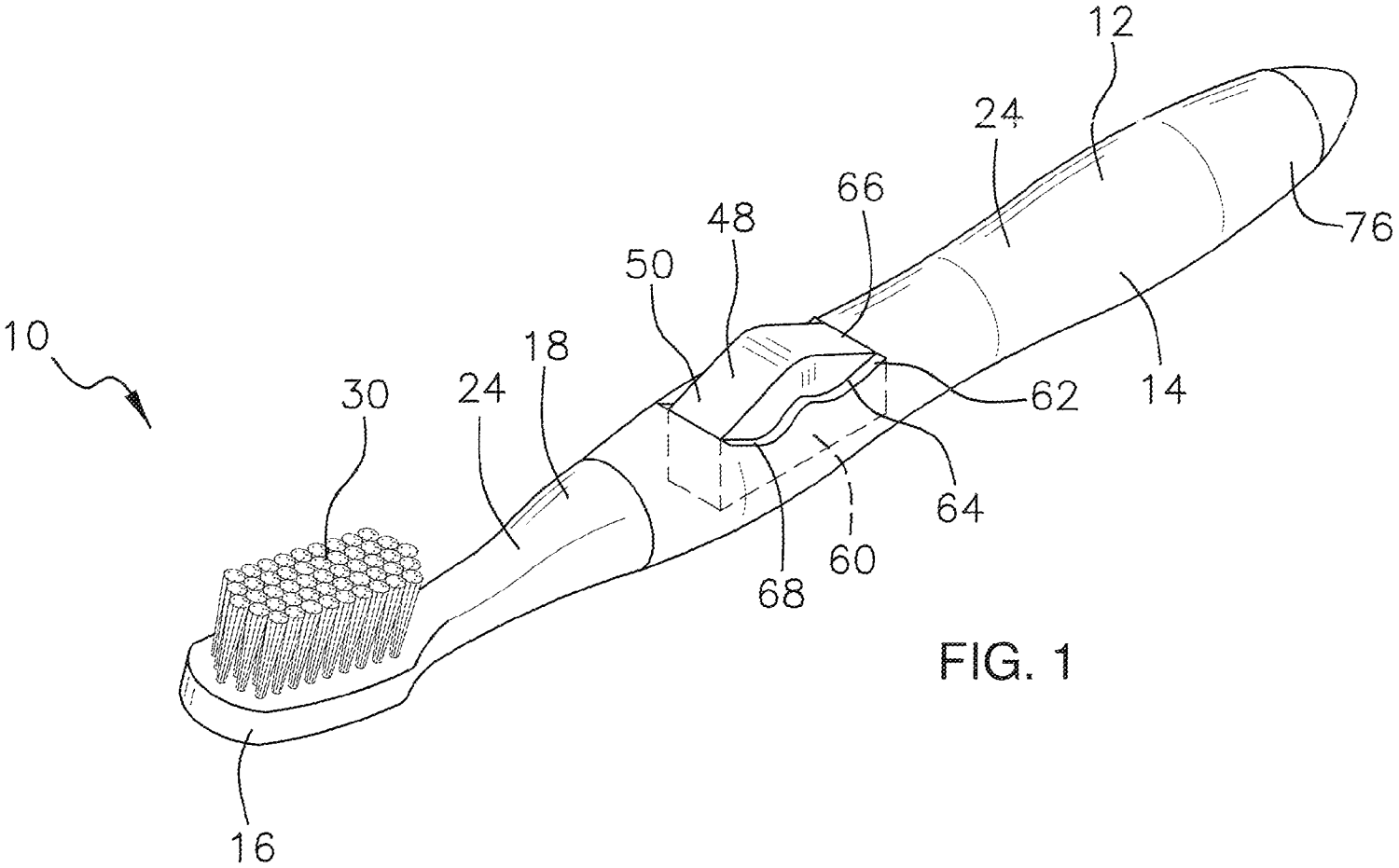
FIG. 1 is a top front side perspective view of a floss-dispensing toothbrush device according to an embodiment of the disclosure.
Figure 2:
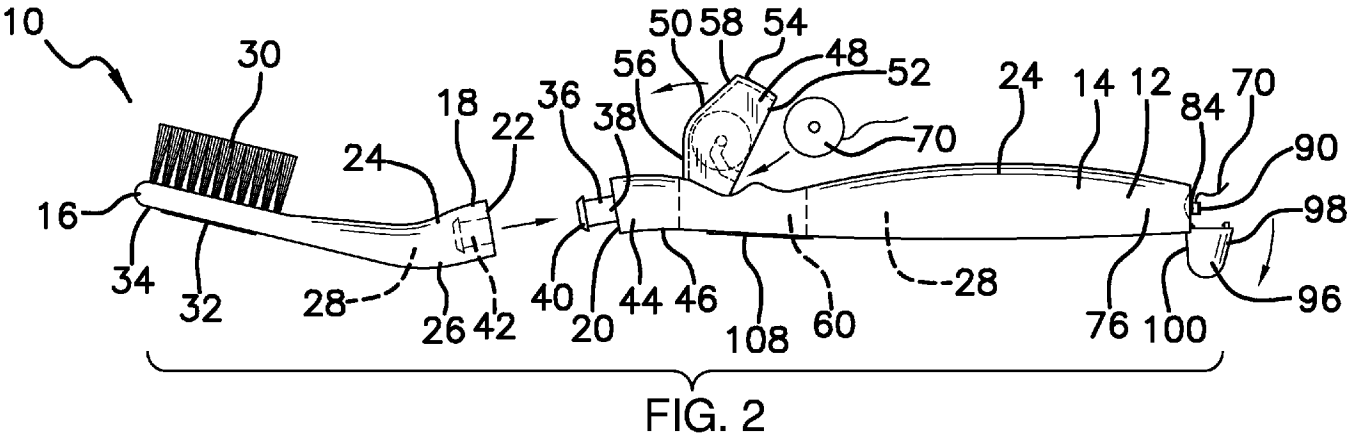
FIG. 2 is a partially-exploded side view of an embodiment of the disclosure in use.
Figure 3:
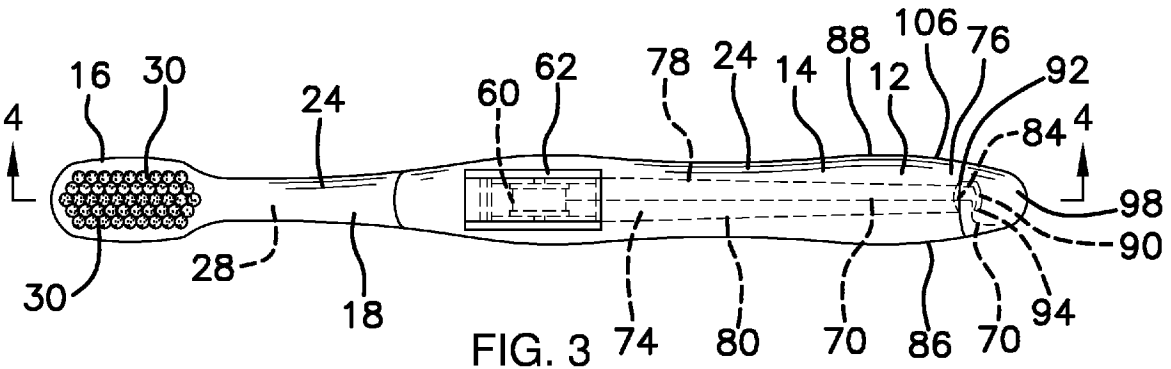
FIG. 3 is a top view of an embodiment of the disclosure.
Figure 4:
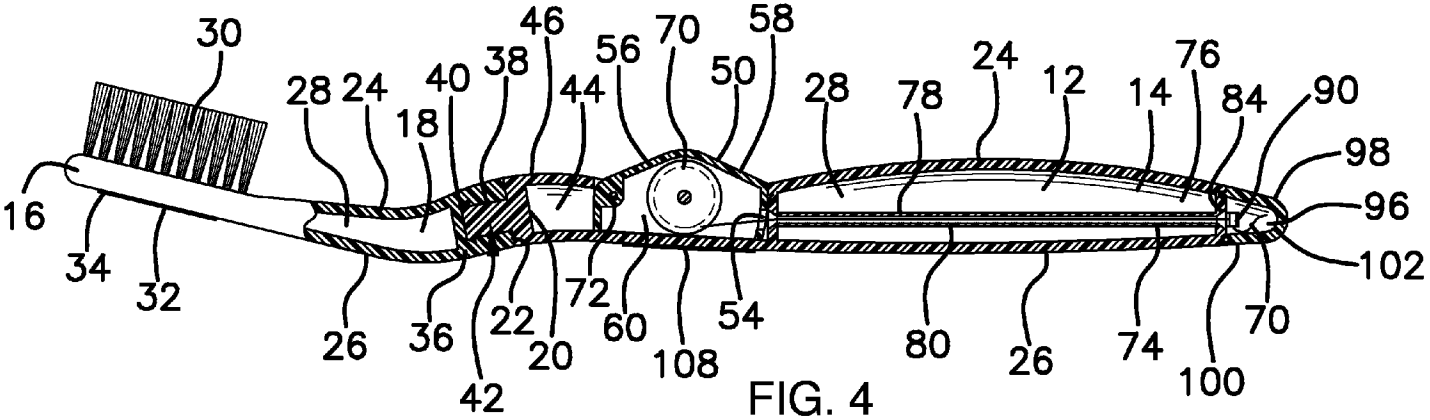
FIG. 4 is a cross-sectional side view of an embodiment of the disclosure in use taken along line 4-4 of FIG. 3.
Figure 5:
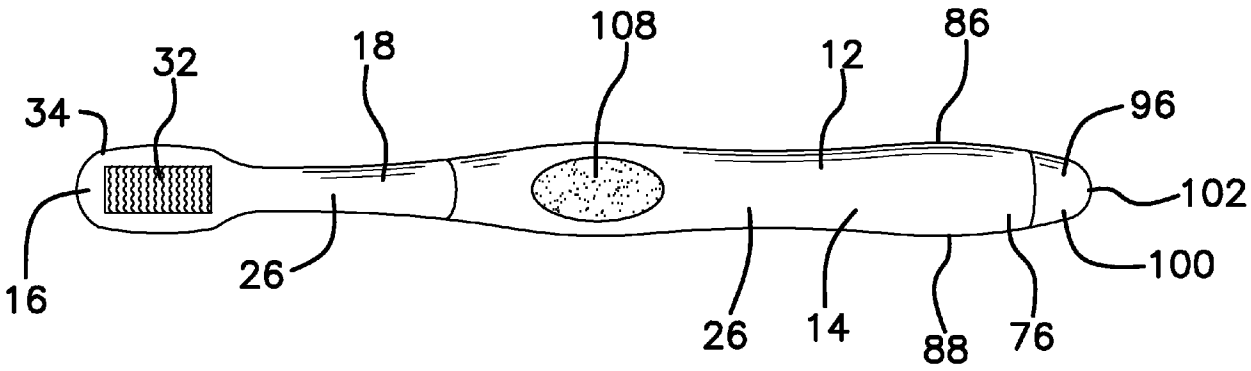
FIG. 5 is a bottom view of an embodiment of the disclosure.

With reference now to the drawings, and in particular to FIGS. 1 through 5 thereof, a new toothbrush device embodying the principles and concepts of an embodiment of the disclosure and generally designated by the reference numeral 10 will be described.

As best illustrated in FIGS. 1 through 5, the floss-dispensing toothbrush device 10 generally comprises an elongated member 12 having a handle 14, a head 16, and a neck 18. The neck 18 is positioned between the head 16 and the handle 14. The head 16 is transversely positioned relative to the handle 14. The neck 18 has an open first end 20. The open first end 20 is curved relative to a second end 22 of the neck 18. The neck 18 and the handle 14 are hollow wherein a top side 24 and a bottom side 26 of the neck 18 and the handle 14 define an interior space 28 of the neck 18 and the handle 14, respectively. A plurality of bristles 30 is coupled to and extends outward from the head 16. The bristles 30 extend from a top side 24 of the head 16. A ridged surface 32 extends across the head 16. The ridged surface 32 extends across a bottom side 34 of the head 16. The ridged surface 32 is configured for cleaning a person's tongue. The elongated member 12 may be made of plastic.

The head 16 and the neck 18 are interchangeable and may be replaced with another head 16 and neck 18, respectively, when desired. A coupler 35 is coupled to and extends from the handle 14. The coupler 36 has a base portion 38 and an outer projection 40 wherein the coupler 36 is configured for selectively coupling the neck 18 to the handle 14 wherein the interior space 28 of the neck 18 comprises a slot 42 configured for receiving the outer projection 40 of the coupler 36 inside the open first end 20 of the neck 18. The base portion 38 is coupled to a first end 44 of the handle 14. The first end 44 of the handle 14 has a pair of curved portions 46. Each of the curved portions 46 is positioned on the top and bottom sides 24, 26 of the handle 14.

A floss housing 48 has a top side 50 positioned opposite an open bottom side 52. The floss housing 48 further comprises a pair of lateral sides 54 extending between the top side 50 and the open bottom side 52 of the floss housing 48. The top side 50 of the floss housing 48 has a first segment 56 coupled to a second segment 58. Each of the first and second segments 56, 58 extends upward and inward from the lateral sides 54 wherein the first segment 56 is coupled to the second segment 58. The floss housing 48 is positioned in a floss cavity 60 within the interior space 28 of the handle 14. The top side 50 of the floss housing 48 extends outward from the floss cavity 60 between a perimeter 62 of the floss cavity 60. The perimeter 62 of the floss cavity 60 has a first pair of lateral edges 64 and a second pair of lateral edges 66. The first pair of lateral edges 64 of the floss cavity 60 extends between the lateral sides 54 of the floss housing 48. The first pair of lateral edges 64 of the floss cavity 60 forms a pair of arcuate depressions 68 spaced and horizontally aligned. The floss cavity 60 is positioned proximate the first end 44 of the handle 14. The floss housing 48 is configured for receiving a spool of floss 70.

A pivot joint 72 couples the floss housing 48 to the floss cavity 60 wherein manipulation of the top side 50 of the floss housing 48 pivots the floss housing 48 to a selectable position relative to the floss cavity 60 wherein the floss housing 48 is pivoted upward when loading the floss 70 into the floss housing 48 and then pivoted downward to dispense the newly-loaded floss 70 from the handle 14. The open bottom side 52 of the floss housing 48 is pivoted upward when the floss housing 48 is pivoted upward wherein the open bottom side 52 of the floss housing 48 is configured for receiving the floss 70.

A conduit 74 extends through the handle 14. The conduit 74 extends from the floss cavity 60 through a second end 76 of the handle 14 wherein the conduit 74 is configured for guiding the floss 70 through the handle 14 and allowing the floss 70 to dispense from the second end 76 of the handle 14. The conduit 74 has an upper edge 78 and a lower edge 80. Each of the upper and lower edges 78, 80 are parallel to the bottom side 26 of the handle 14. An aperture 84 is positioned in the handle 14.

The aperture 84 is positioned in the second end 76 of the handle 14 between an outer segment 86 and an inner segment 88 of the handle 14. The aperture 84 is coupled to the conduit 74 and configured for receiving the floss 70 from the conduit 74 wherein a person pulls the floss 70 out from the aperture 84 to a desired length. A floss cutter 90 is coupled to the handle 14 proximate the aperture 84. The floss cutter 90 has a straight portion 92 coupled to a curved portion 94 wherein the floss cutter 90 is configured for cutting the floss 70 dispensed through the aperture 84.

A hollow end cap 96 is hingedly coupled to the handle 14. The end cap 96 is coupled to and extends from the second end 76 of the handle 14 wherein a top side 98 of the end cap 96 is selectively removable for dispensing the floss 70 from the handle 14 wherein a bottom side 100 of the end cap 96 is coupled to the second end 76 of the handle 14. The end cap 96 has an arcuate end 102 coupled to and extending between the top and bottom sides 98, 100 of the end cap 96 wherein the top side 24 of the handle 14 and the end cap 96 define a curved portion 106 of the handle 14 positioned above the conduit 74. A gripping surface 108 is coupled to the handle 14. The gripping surface 108 is coupled to the bottom side 82 of the handle 14 proximate the first end of the handle 14. The gripping surface 108 is positioned below the floss cavity 60. The griping surface 108 may be made of rubber.

In use, as stated above and shown in the Figures, the top side 50 of the floss housing 48 is manipulated such that the floss housing 48 is pivoted upward to load the floss 70 into the floss housing 48 and then pivoted downward when ready to dispense the newly-loaded floss 70 from the handle 14. The conduit 74 guides the floss 70 through the handle 14. A person pulls the floss 70 out from the aperture 84 and uses the floss cutter 90 to cut the floss 70. The ridged surface 32 is rubbed against and cleans a user's tongue. One of the user's fingertips is placed on the gripping surface 108 when brushing the user's teeth.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A floss dispensing toothbrush device comprising:

an elongated member having a head coupled to a handle, a top side and a bottom side of said handle defining an interior space of said handle;

a plurality of bristles coupled to and extending outward from said head;

a ridged surface extending across said head, said ridged surface being configured for cleaning a person's tongue;

a floss housing being coupled to and positioned in a floss cavity within said interior space of said handle, said floss housing being configured for receiving a spool of floss;

a conduit extending through said handle, said conduit extending from said floss cavity wherein said conduit is configured for guiding the floss through said handle and allowing the floss to dispense from said handle; and an aperture being positioned in said handle, said aperture being coupled to said conduit and configured for receiving the floss from the conduit wherein a person pulls the floss out from said aperture to a desired length; and a pivot joint coupling said floss housing to said floss cavity wherein said floss housing is pivotable away from said handle and out of said floss cavity wherein said floss housing is configured for being pivoted upward when loading the floss into said floss housing and then pivoted downward to dispense newly-loaded floss from said handle.

2. The device of claim 1, further comprising said ridged surface extending across a bottom side of said head.

3. The device of claim 1, further comprising said elongated member having a neck positioned between said head and said handle.

4. The device of claim 3, further comprising said head being removably coupled to said neck.

5. The device of claim 4, further comprising a coupler coupled to and extending from said handle wherein said coupler is configured for selectively coupling said neck to said handle.

6. The device of claim 5, further comprising a first end of said handle having a pair of curved portions, each of said curved portions being positioned on a top side and a bottom side of said handle.

7. The device of claim 3, further comprising said neck having an open first end, said open first end being curved relative to a second end of said neck.

8. The device of claim 1, further comprising a floss cutter coupled to said handle proximate said aperture wherein said floss cutter is configured for cutting the floss dispensed through said aperture.

9. The device of claim 8, further comprising said floss cutter having a straight portion coupled to a curved portion.

10. The device of claim 1, further comprising a hollow end cap coupled to said handle.

11. The device of claim 10, further comprising said end cap being hingedly coupled to said handle.

12. The device of claim 1, further comprising a gripping surface coupled to said handle.

13. The device of claim 12, further comprising said gripping surface being coupled to said bottom side of said handle proximate a first end of said handle, said gripping surface being positioned below said floss cavity.

14. The device of claim 1, further comprising said conduit extending through a second end of said handle.

15. The device of claim 1, further comprising said floss cavity being positioned proximate a first end of said handle.

16. A floss dispensing toothbrush device comprising:

an elongated member having a handle, a head, and a neck, said neck being positioned between said head and said handle, said head being transversely positioned relative to said handle, said neck having an open first end, said open first end being curved relative to a second end of said neck, said neck and said handle being hollow wherein a top side and a bottom side of said neck and said handle define an interior space of said neck and said handle, respectively;

a plurality of bristles coupled to and extending outward from said head, said bristles extending from a top side of said head;

a ridged surface extending across said head, said ridged surface extending across a bottom side of said head, said ridged surface being configured for cleaning a person's tongue;

a coupler coupled to and extending from said handle, said coupler having a base portion and an outer projection wherein said coupler is configured for selectively coupling said neck to said handle wherein said interior space of said neck comprises a slot configured for receiving said outer projection of said coupler inside said open first end of said neck, said base portion being coupled to a first end of said handle, said first end of said handle having a pair of curved portions, each of said curved portions being positioned on said top and bottom sides of said handle;

a floss housing having a top side positioned opposite an open bottom side, said floss housing further comprising a pair of lateral sides extending between said top side and said open bottom side of said floss housing, said top side of said floss housing having a first segment coupled to a second segment, each of said first and second segments extending upward and inward from said lateral sides wherein said first segment is coupled to said second segment, said floss housing being positioned in a floss cavity within said interior space of said handle, said top side of said floss housing extending outward from said floss cavity between a perimeter of said floss cavity, said perimeter of said floss cavity having a first pair of lateral edges and a second pair of lateral edges, said first pair of lateral edges of said floss cavity extending between said lateral sides of said floss housing, said first pair of said lateral edges of said floss cavity forming a pair of arcuate depressions spaced and horizontally aligned, said floss cavity being positioned proximate said first end of said handle, said floss housing being configured for receiving a spool of floss;

a pivot joint coupling said floss housing to said floss cavity wherein said floss housing is pivotable away from said handle and out of said floss cavity wherein said floss housing is configured for being pivoted upward when loading the floss into said floss housing and then pivoted downward to dispense newly-loaded floss from said handle, said open bottom side of said floss housing being pivoted upward when said floss housing is pivoted upward wherein said open bottom side of said floss housing is configured for receiving the floss;

a conduit extending through said handle, said conduit extending from said floss cavity through a second end of said handle wherein said conduit is configured for guiding the floss through said handle and allowing the floss to dispense from said second end of said handle, said conduit having an upper edge and a lower edge, each of said upper and lower edges being parallel to said bottom side of said handle;

an aperture being positioned in said handle, said aperture being positioned in said second end of said handle between an outer segment and an inner segment of said handle, said aperture being coupled to said conduit and configured for receiving the floss from the conduit wherein a person pulls the floss out from said aperture to a desired length;

a floss cutter coupled to said handle proximate said aperture, said floss cutter having a straight portion coupled to a curved portion wherein said floss cutter is configured for cutting the floss dispensed through said aperture;

a hollow end cap hingedly coupled to said handle, said end cap being coupled to and extending from said second end of said handle wherein a top side of said end cap is selectively removable for dispensing the floss from said handle wherein a bottom side of said end cap is coupled to said second end of said handle, said end cap having an arcuate end coupled to and extending between said top and bottom sides of said end cap wherein said top side of said handle and said end cap define a curved portion of said handle positioned above said conduit; and a gripping surface coupled to said handle, said gripping surface being coupled to said bottom side of said handle proximate said first end of said handle, said gripping surface being positioned below said floss cavity.

* * * * *